United States Patent [19]

Jukes

[11] 4,442,644

[45] Apr. 17, 1984

[54] FRAME MEMBER FOR USE WITH CONSTRUCTION BLOCKS

[75] Inventor: Christoher E. Jukes, Vancouver, Canada

[73] Assignee: Mod-Lok Industries, Ltd., Vancouver, Canada

[21] Appl. No.: 276,077

[22] Filed: Jun. 22, 1981

[51] Int. Cl.[3] ..... E06B 1/04

[52] U.S. Cl. ..... 52/213; 52/216; 52/426; 52/436; 52/562; 52/594

[58] Field of Search ..... 52/211, 212, 213, 215, 52/381, 383, 434, 435, 442, 455, 458, 503, 513, 562, 566, 715, 735, 216, 405, 410, 597, 598, 599; 49/504

[56] References Cited

U.S. PATENT DOCUMENTS

| | | | |
|---|---|---|---|
| 1,085,605 | 2/1914 | Gunn | 52/216 X |
| 1,287,622 | 12/1918 | Berrill et al. | 52/715 |
| 1,361,586 | 12/1920 | Johnson | 52/715 X |
| 2,574,350 | 11/1951 | Peelle | 52/213 |
| 2,919,572 | 1/1960 | Salzi | 52/381 |
| 3,546,815 | 12/1970 | Kimberley | 49/504 |
| 3,676,967 | 7/1972 | Frati | 52/220 |
| 4,149,349 | 4/1979 | Nilsen et al. | 52/381 |
| 4,226,066 | 10/1980 | Persson | 49/504 X |
| 4,348,847 | 9/1982 | Jukes | 52/383 X |

*Primary Examiner*—Alfred C. Perham
*Assistant Examiner*—David J. Thomas
*Attorney, Agent, or Firm*—Harlan P. Huebner

[57] ABSTRACT

A frame member for a door or window wherein the member is for use within a wall formed of consumable building blocks. The frame member includes upright structural column jambs and a header member extending between the jambs and united thereto and tie means to unite the frame member with the blocks of said wall adjacent thereto.

6 Claims, 7 Drawing Figures

FIG. 1.
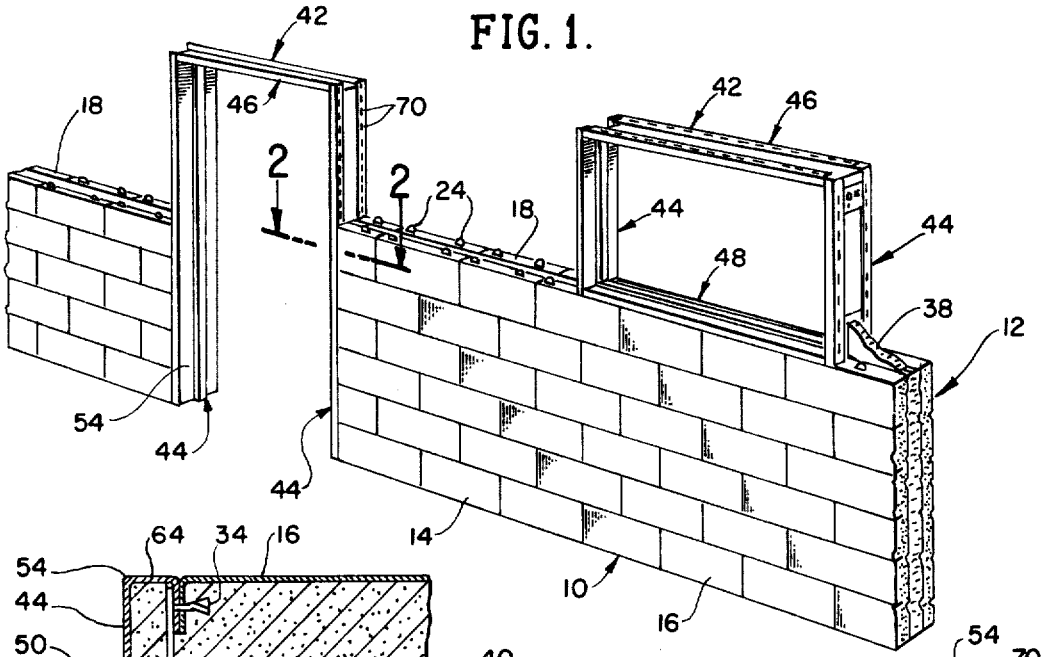
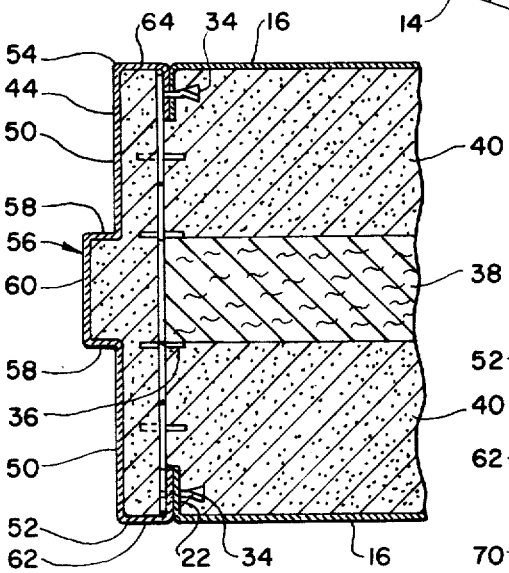
FIG. 2.
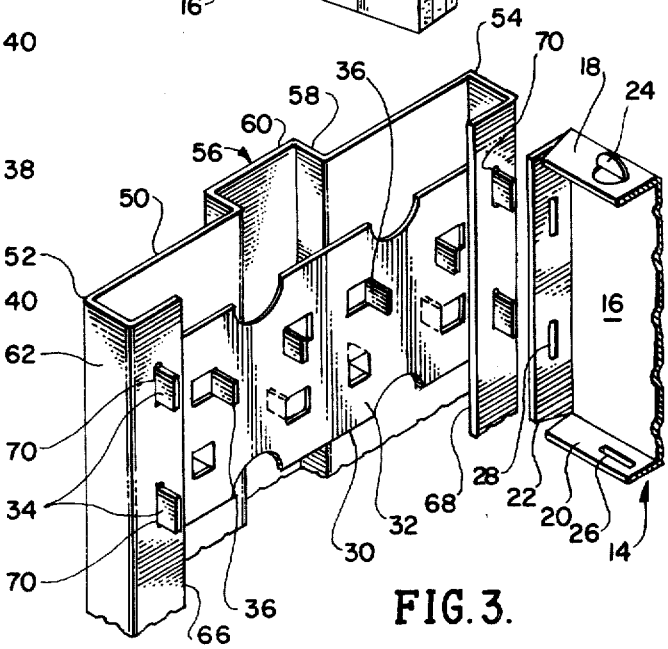
FIG. 3.
FIG. 4.
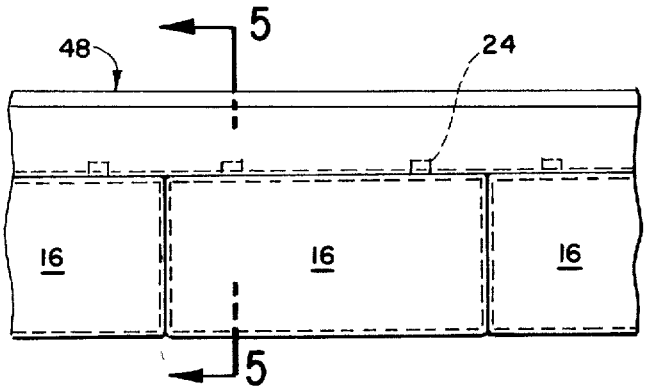
FIG. 5.
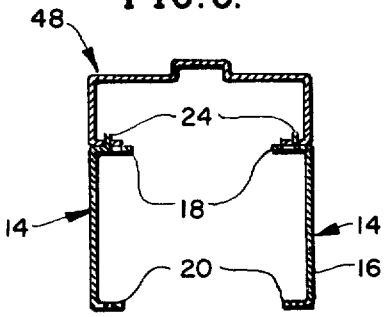

FRAME MEMBER FOR USE WITH CONSTRUCTION BLOCKS

BACKGROUND OF THE INVENTION

The present invention relates to a frame member for doors or windows in a building wherein the member is for use with an assembly in forming a concrete wall structure made up of prefabricated consumable blocks. An illustration of an assembly forming the concrete wall structure is described, illustrated and claimed in U.S. Pat. No. 4,149,349, granted Apr. 17, 1979. The block structure of that patent includes a pair of spaced apart sidewalls or plates which are in parallel arrangement and innerconnected at their respective ends by transverse tie members. These tie members have lugs or tabs which are outwardly struck from the plane of the member to receive insulating material therebetween. A plurality of these assemblies or blocks are united together by grooves and tabs to form a building structure wall and then upon completion of the wall the blocks are filled with concrete to fill the wall structure.

With the construction of building structure walls utilizing the assembly of U.S. Pat. No. 4,149,349 there have been shortcomings involved when it became necessary to position a door or window within the wall structure. In the past the side panels or plates of the structure described and claimed in the aforesaid patent were bent inwardly toward each other whereby an opening was formed in the various wall courses. In order to finish the opening any type of standard door frame or window frame was placed in position in the opening abutting the blocks.

This created the necessity for bracing the structure in place until such time as concrete was poured into the wall of the building structure and allowed to set. Additional time was then required to remove the bracing and supports from the opening after the concrete had set. After the entire wall had set then an appropriate door or window could be hung or positioned within the frame member.

Before the advent of even the metalic blocks, in the case of ordinary concrete block walls standard metal door frames used in industrial and commercial applications were attached to the concrete blocks by the use of T bars which were inserted into the concrete block so that the door frame remained in place. The difficulty with such a structure was that the door frame because it could not be poured with concrete enjoyed a lesser fire rating than the present invention.

SUMMARY OF THE INVENTION

It is accordingly an object of the present invention to provide a frame member which is preferably formed from metal and is hollow which is united with and becomes an integral part of the consumable module predetermined dimensional building blocks when stacked in courses forming a wall of the building structure. Upon uniting the frame member and the blocks together, the entire wall and frame member may be poured with concrete and in this manner the entire structure will enjoy a much higher fire rating than the standard fire door does at the present time. In other words, both the frame and the wall are solid and filled with concrete, forming a complete unit.

In addition, with the uniting of the frame member and the courses of the wall there is a rigidity developed whereby it becomes unnecessary to brace or support the frame members for either windows or doors within the walls of the building structure during pouring of concrete. This saves the additional time of the workman of having to both initially brace the structure and then upon setting of the concrete removing the bracing and supports for insertion of a window or door.

It is a further object of the present invention to provide a pair of upright structural column jambs where in each has a face plate with a stop projection extending therefrom and that at each longitudinal edge of the base plate the material is bent inwardly therefrom forming flanges spaced from said face plate and extending toward each other. The flanges each have a plurality of slots formed therethrough for alignment with slots in the building blocks such as defined in U.S. Pat. No. 4,149,349 or similar assemblies so that the wall and jambs may be united and become integral one with the other.

It is a further object of this invention to provide a header member extending between the upright structural column jambs and united thereto. The header may be inserted in an appropriate slot formed in the respective column jambs and upon alignment whereby one is normal to the other the header and each of the column jambs may be welded to each other or secured by other means forming an exact 90° angle one with the other. With this prearranged forming of the frame to assure a 90° relationship between the uprights, the headers and/or the sill is assured. This will accomplish appropriate alignment within the wall structure and upon uniting with the various courses of the wall the need for bracing or supporting the frame members during the pouring of concrete in the wall is unnecessary.

Another object of the invention is to form a frame member such as stated in the above paragraph wherein there is a sill member which is similar to the header member and extends between the upright structure column jambs at the bottom thereof to form a complete closure and a space therebetween the respective upright jambs, header and sill will receive an appropriate window.

Further objects and advantages of the invention will be brought out in the following part of the specification wherein small details have been described for the completeness of disclosure, without intending to limit the scope of the invention which is set forth in the appended claims.

BRIEF DESCRIPTION OF THE DRAWINGS

FIG. 1 is a perspective environmental view illustrating two types of frame members positioned in a wall formed of building blocks;

FIG. 2, is a cross sectional view taken on line 2—2 of FIG. 1 showing the frame united with one course of the wall and the attachment therebetween;

FIG. 3, is a perspective view of a transverse spacer member of a building block extending through a portion of the vertical frame member to unite the vertical frame member with a course of the wall of the building blocks;

FIG. 4, is a front elevational view of the sill portion of the frame member attached to the top of a course of building blocks;

FIG. 5, is a cross sectional view taken on line 5—5 of FIG. 4;

DETAILED DESCRIPTION OF THE PREFERRED EMBODIMENT

Figure 6:
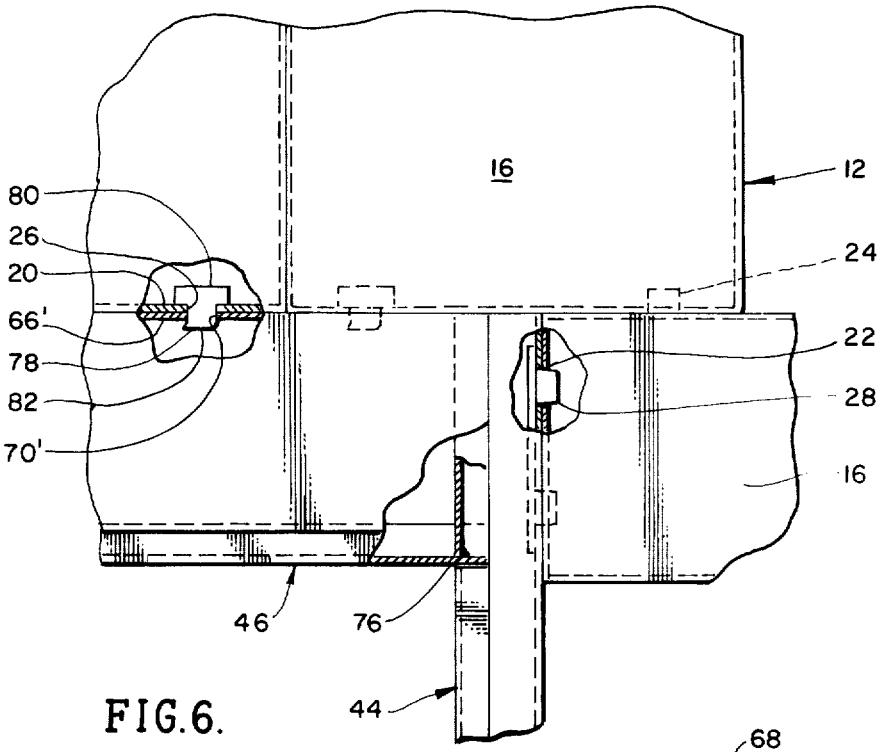
FIG. 6, is a front elevational view partially cut away illustrating tie means to unite the frame member with the building blocks.

Referring to the drawings in more detail, as shown in FIG. 1, a wall 10 is made up of a plurality of consumable wall forming modular blocks generally designated 12. The plurality of modular blocks 12, as shown, are laid in courses one above the other and are innerlocked together to form the structure. The drawing illustrates six courses of the wall 10.

For purposes of identification each modular block structure 12 includes a pair of inner and outer side plates 14. Each plate 14 has a plannar body portion 16 surrounded by peripheral edges made up of top and bottom flanges 18 and 20 and opposed end of flanges 22. The entire side plate 14 may be formed from a single sheet of metal, for example, by stamping with the flanges 18, 20 and 22 making up the edge portions being formed by bending the borders of the planner body 16 into planes perpendicular to the major plane or surface. It has been found in construction that preferably the length of the respective side plates 14 are made in 8" and 16" lengths. These lengths are found most suitable for wall forming with overlapping courses, corner construction or construction or pilasters or columns.

The planner body portion 16 of the blocks 12 may be smooth as illustrated in the drawings to form the interior and exterior of the wall or they may be corrugated or in some other way roughened whereby plaster or cement may be applied to hide and cover the body portions 16.

As can be seen in FIGS. 1 and 3 each of the side plates 14 includes a plurality of upward projections, tabs or lugs 24 on the top flanges 18. With regard to the bottom flanges 20 of each of the plates 16, they are provided with slots 26 whereby when one side plate 14 is placed upon another such as in the courses illustrated in FIG. 1 the tabs 24 will be inserted through the slots 26 to locate the side plates in position and lock the blocks of the respective courses together.

In addition, each of the flanges 22 of the side plates 14 have vertically aligned slots 28.

In practice, each of the blocks 12, are equipped with transverse spacer members generally designated 30, best illustrated in FIG. 3. In order to position each of the side plates 14 in parallel spaced relationship, such as seen in FIG. 2, a pair of spacer members 30 includes a plate section 32 which includes end tabs or lugs 34 which are adapted to extend through the slots 28 in the end flanges 22 of the plates 14. After the tabs or lugs 34 are placed through the slots 28 they may be twisted whereby the spacer member 30 is permanently secured through flange 22 to the respective side plate 16. In addition, the spacer member 30 may be formed with central tabs 36 extending upwardly from the plate section 32 in one direction normal to the plain thereof. These tab portions 36 being spaced one from the other, as can best be seen in FIG. 3, are provided to receive sheet insulation 38 which extend between the respective transverse spacer members parallel with and spaced from each of the respective side plates of each block 12. Once the wall module blocks 12 and frames are arranged in courses and united such as seen in FIG. 1 concrete 40 may be poured within the block assemblies 12 on each side of the insulation 38 as best seen in FIG. 2. The wall thus formed is complete leaving exposed the side plate 16 on both the exterior and interior portions of the wall for further finishing if necessary.

With the advent of wall structure such as previously described, it has become necessary to develop framing members which may be positioned in the wall 10 forming appropriate openings for either doors or windows. There is illustrated in FIG. 1 a frame member generally designated 42 which can be identical for window or door openings with the exception that when the frame member is to be utilized as an opening or a window, a sill is generally provided. It is placed at the bottom of the frame member 42, such as illustrated in FIGS. 1, 4 and 5.

In further detail, the frame member 42, whether it be for a window or for a door, includes a pair of upright structural column jambs generally designated 44, and a header member generally designated 46.

When the frame member 42 is to be utilized as a window frame member a sill member generally designated 48 is used such as best seen in FIG. 1.

Each of the jambs, headers and sills 44, 46 and 48, may be made of the same gauge metal as found in the modular blocks 12. In addition, the shape and configuration of the respective jambs, headers and sill members, are identical one with the other. In some cases, the metal is fabricated in the shape to be hereinafter described and upon arrival at the building site may be cut into appropriate lengths forming the column jambs 44, headers 46 and sills 48, and the respective members can be united at the site by welding or other means to make a complete frame.

Each of the structural column jambs 44 includes a face plate portion 50 which extends between exterior side edges 52 and 54. Intermediate the exterior side edges 52 and 54, is a stop projection generally designated 56, which is formed by bending the face plate portion outwardly forming a pair of space apart stop walls 58 with a jamb wall 60 extending therebetween. At the exterior side edges 52 and 54 respectively the column jamb 44 is bent inwardly forming an interior edge 62 and exterior edge wall 64. Each of the edge walls 62 and 64 are then bent back inwardly toward each other forming interior and exterior flanges 66 and 68. Each of the flanges 66 and 68 include slots 70.

The header or lintel member 46 may in the case of a window frame structure 42 be identical in shape and dimension with the column jambs 44 which have just been described. This is so, because generally speaking the space formed for a window is smaller than for a door frame and the stress factor is not as great so that the span between the respective jambs of 44 structurally does not require a heavier type of header or lintel.

Figure 7:
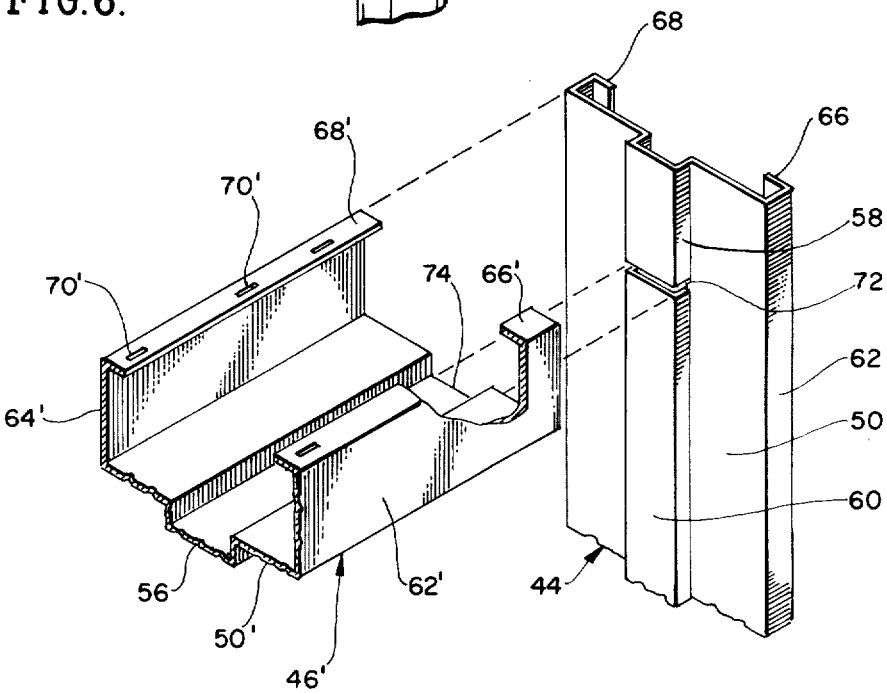
FIG. 7, is a perspective exploded view of one of the upright structural column jambs and the header member showing how the two members are united.

However, when it comes to the formation of a frame member 42 for use as a door frame it may be necessary to increase the various dimensions of the header or lentil 46' such as seen in FIG. 7. In FIG. 7, while the face portion 50' is identical in width to that of the structural column jambs 44 and also the construction and dimension of the stop projection 56 is the same, the width of the interior edge wall 62' and exterior edge wall 64' is wider than that of the structural column jambs 44. The flanges 66' and 68' are generally the same dimension as in the jambs 44 as are the slots 70'.

In order to secure a header member 46' to the upright structural column jambs 44 a slot 72 is preferably cut through the stop walls 58 and jamb walls 60. In order to attach the respective members the stop projection end edge 74 is inserted into the slots 72 so that the end of the header butts and is flush with the face place portion 50 of each of the column jambs 44. In order to secure the respective elements firmly together they may be welded together such as seen in FIG. 6 at 76 or otherwise secured in permament fashion one with the other.

When a sill 48 is to be utilized forming a frame member adapted to receive a window the sill member 48 is again identical in construction and dimension with the jambs 44. The sill extending between each of the column jambs 44 may be secured thereto by welding or any other appropriate means to complete the box frame.

In order to assemble the frame member 44 to form a doorway opening within a wall 10 the flanges 66 and 68 of the column jambs are butted against the flanges 28 of the side members 16 of a modular block member 12. Each of the flanges 66 are aligned with respective flanges 22 so that the slots 28 in the flanges 22 of the blocks in various courses are aligned with the slots 70 in the flanges 66 and 68. In order to attach the respective elements, the lugs or tabs 34 of the spacer members 30 are preferably inserted through the respective slots 70 and 28 and once in position as seen in FIG. 2, they are twisted in order to lock the column jambs 44 and wall block structure together.

While in the preferred embodiment the spacer members 30 and the lugs 34 are used to lock the members, other means may be used to lock the respective block and portion of the frame member together.

When it comes to locking the header or lintel 46 of the frame member 42 to a course of wall 10, it is best seen in FIG. 6, that the modular blocks 12 are laid on the top of the flanges 66' and 68' whereby the slots 70' are in alignment with the slots 26 of respective blocks 12. In order to lock the header and several of the block members 12 together, a tie means generally designated 78 is used. This tie means 78 is generally T shaped, as best seen in FIG. 6. The top of the T 80 has a length greater than the slots 70' and 26 and rests on the inside of the flange 20, again, as best seen in FIG. 6. The leg 82 of the T 78 extends through the respective slots and is preferably bent or twisted whereby the members are locked together to form the integral wall and door or window frame member units.

Once the frame member 42 is in position within the walls, such as seen in FIG. 1, the assembly is then ready for the pouring of concrete 40. As can be seen from the drawings the pouring of the concrete will allow the material to not only fill the void between the insulation material 38 and the respective interior and exterior side walls 16 of the blocks 12, but will also fill the space in the jambs 44 between the face plate portion 50 and spacer members 30. Further, the concrete 40 will fill the space in the header or lintel 46 and extend upwardly between and fill the voids of the upper blocks 12. In this way, it can be seen that there is a solid integral structure of the wall 14 and frame member 42 without the need for bracing or supporting the frame members 42 during the pouring of the concrete or the setting of the concrete.

Once the wall structure and frames are filled with cement and the cement has set, the frame members 42 are then in a condition to receive either a door which is mounted therein by any conventional means or a window which may also be mounted in the frame member by any conventional means.

It can be seen that when the frame member 42 is properly utilized and integrated with the blocks 12 forming the wall 10, the structure, when filled with concrete is united as a single structure. This type of structure, in the case of fire door construction, is much more efficient and deter fire from breaking therethrough to a much longer extent than is presently available by standard door frames which may be connected to concrete blocks and other wall structures.

The invention and its intended advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to specific forms shown or used as mentioned except as defined in the accompanied claims, wherein various portions have been separated for clarity and reading and not for emphasis.

I claim:

1. A frame member for use with a plurality of consumable modular building blocks to form an opening therein, said blocks being stacked in courses forming a wall of a building structure and each block includes a pair of side plates and a pair of transverse spacer members at each end of said plates spacing one plate from the other to create a block of rectangular configuration, and adapted to receive concrete therein, each side plate having top edges including spaced apart upward lug projections and lower edges including corresponding slots, and each side having end edges including slots, said frame member including:

a pair of upright structural column jambs, each including a face plate portion having exterior edge walls with a stop projection extending therefrom the length of each of said column jambs and spaced between said exterior edge walls thereof, and said column jambs at each of said exterior edge walls bent inwardly therefrom forming flanges spaced from said face plate portion generally parallel with said face plate portion and extending toward each other, and a plurality of slots formed through each flange;

a header member extending between said upright structural column jambs and united thereto, said header member having a cross sectional configuration similar to said jambs including slots formed through said flanges and with the stop projection aligned with said stop projections of said jambs;

said column jambs and said header member positioned in said wall whereby the flanges of said column jambs abut the end edges of said building blocks of various courses and the flanges of said header abuts said lower edges of a plurality of blocks forming a course above said header; and tie means to unite said column jambs, and said header member with said blocks whereby said combination of wall and frame member are fixed to each other; said tie means for said header is a clip member of a thickness adapted to extend through said slots and is generally T shaped and the leg of said T extends through adjacent aligned slots of said header and said block and the top of said T is longer than said slots and said leg of said T is bent whereby the members are locked one to the other.

2. A frame member is defined in claim 1 wherein said structural column jambs and header member define a space therebetween for the placement of a door on either side of said stop projections.

3. A frame member as defined in claim 1 wherein the space between said flanges and said face plate portions of said jambs and header is adapted to receive concrete whereby the strength of said wall and frame member is increased.

4. A frame member as defined in claim 1 wherein said frame member includes; a sill member extending between said upright structural column jambs and united thereto below said header and said sill member having a cross sectional configuration identical with said jambs including slots formed through said flanges adapted to receive said upward lug projections of said blocks and rest on the top of a portion of a course of said wall.

5. A frame member as defined in claim 1 wherein said structural column jambs, said header member and said sill member define a closed space therebetween for the placement of a window on either side of said stop projections.

6. A frame member as defined in claim 1 wherein said tie means for said column jambs are tabs extending from said transverse spacer member through said slots of said flanges and said slots of said end edges of a said plate and said tabs are of a thickness adapted to extend through said slots and said tabs may be deformed to lock said column jamb to the blocks of at least several courses.

* * * * *